US010694848B2

(12) United States Patent
Ciaponi

(10) Patent No.: US 10,694,848 B2
(45) Date of Patent: Jun. 30, 2020

(54) INTERCHANGEABLE DRAWER COVER FOR FURNITURE

(71) Applicant: Jeanne Ciaponi, Wichita, KS (US)

(72) Inventor: Jeanne Ciaponi, Wichita, KS (US)

( * ) Notice: Subject to any disclaimer, the term of this patent is extended or adjusted under 35 U.S.C. 154(b) by 0 days.

(21) Appl. No.: 16/166,750

(22) Filed: Oct. 22, 2018

(65) Prior Publication Data

US 2019/0116975 A1 Apr. 25, 2019

Related U.S. Application Data

(60) Provisional application No. 62/574,798, filed on Oct. 20, 2017.

(51) Int. Cl.

| | |
|---|---|
| ***A47B 88/919*** | (2017.01) |
| ***A47B 67/04*** | (2006.01) |
| ***A47B 96/20*** | (2006.01) |
| *A47B 88/938* | (2017.01) |

(52) U.S. Cl.

CPC ..... *A47B 88/919* (2017.01); *A47B 67/04* (2013.01); *A47B 96/206* (2013.01); *A47B 2088/939* (2017.01); *A47B 2210/08* (2013.01)

(58) Field of Classification Search

CPC . A47B 96/206; A47B 67/04; A47B 2088/939; A47B 2210/08; A47B 88/944; A47B 95/02; A47B 88/95; A47B 88/956; A47B 2088/951; A47B 88/0055; A47B 88/941; A47B 2088/953; A47B 2088/954; A47B 2088/952; A47B 88/90; A47B 88/919

USPC ..... 312/348.4, 348.6

See application file for complete search history.

(56) References Cited

U.S. PATENT DOCUMENTS

| | | | | | |
|---|---|---|---|---|---|
| 3,024,075 | A | | 3/1962 | Howe | |
| 3,589,788 | A | * | 6/1971 | Kaiden | A47B 95/00 312/265.1 |
| 3,716,283 | A | * | 2/1973 | Little | A47B 88/944 312/265.1 |
| 4,900,378 | A | * | 2/1990 | Wistehuff | A47B 96/201 156/63 |
| 5,549,267 | A | * | 8/1996 | Armbruster | G06F 1/1607 248/442.2 |
| 5,951,133 | A | * | 9/1999 | Dittberner | A47B 88/944 312/332.1 |
| 6,139,945 | A | * | 10/2000 | Krejchi | B32B 5/18 428/317.9 |
| 2003/0091784 | A1 | * | 5/2003 | Nykamp | A47B 96/206 428/99 |
| 2003/0145377 | A1 | * | 8/2003 | Paul | A47C 19/022 5/53.1 |
| 2003/0222547 | A1 | * | 12/2003 | Trees | A47B 77/00 312/204 |

(Continued)

*Primary Examiner* — Hiwot E Tefera

(74) *Attorney, Agent, or Firm* — Allen, Dyer et al.

(57) ABSTRACT

An interchangeable drawer cover for furniture includes a substrate having a first surface and a second surface, where the substrate comprises a first material. The drawer cover also includes a first decorative layer overlaying the first surface of the substrate, and a second decorative layer overlaying the second surface of the substrate, where the first and second decorative layers comprise a second material. In addition, the substrate, the first decorative layer, and the second decorative layer are sized and shaped to fit over a front of a drawer of the furniture.

6 Claims, 2 Drawing Sheets

(56) References Cited

U.S. PATENT DOCUMENTS

| | | | | |
|---|---|---|---|---|
| 2007/0018541 | A1* | 1/2007 | Hacker | E05G 1/00 312/204 |
| 2009/0153006 | A1 | 6/2009 | Hazzard et al. | |
| 2009/0159363 | A1* | 6/2009 | Weber | A47B 83/04 181/290 |
| 2011/0052863 | A1* | 3/2011 | Sweeney | B32B 5/18 428/137 |
| 2011/0281131 | A1* | 11/2011 | Roberts | B29C 53/066 428/542.2 |
| 2012/0223628 | A1* | 9/2012 | Evangelidis | A47B 88/956 312/326 |
| 2013/0337220 | A1* | 12/2013 | Janke | A47B 95/04 428/99 |
| 2016/0136920 | A1* | 5/2016 | Carroll | B42D 5/002 493/137 |
| 2016/0235192 | A1* | 8/2016 | Kramer | B29C 65/4865 |
| 2018/0125239 | A1* | 5/2018 | Selvan | B29C 48/16 |

* cited by examiner

INTERCHANGEABLE DRAWER COVER FOR FURNITURE

RELATED APPLICATION

The present invention is related to U.S. Provisional Patent Application Ser. No. 62/574,798 filed Oct. 20, 2017, the entire contents of which are incorporated herein by reference.

TECHNICAL FIELD

The present invention relates to the field of furniture, and, more particularly, to an interchangeable drawer cover for furniture.

BACKGROUND

Household furniture and cabinets are most often constructed of wood and typically stained or painted. The colors with which the furniture or cabinets is stained or painted may go out of style over the years. To change color, it is necessary to either purchase new furniture or cabinets or to refinish the existing furniture and cabinets, which can be expensive and inconvenient.

In addition, besides becoming outdated, the finishes of furniture or cabinets can be scratched or otherwise marred over time. This can also lead to expensive refinishing or repairs.

Another issue that can arise is being able to match the color and style of new furniture to the existing furniture. The new furniture may be made by a different manufacturer offering different colors, or may be made by the same manufacturer no longer offering the old colors. Even if a color is still made by the previous manufacturer, the new furniture may not match the existing furniture due to fading, or differences in the manufacturing process.

It is desirable, therefore, to provide an interchangeable drawer cover for furniture that can be used for decoration purposes, creating a theme throughout a room, and address the shortcomings in the art.

SUMMARY

In a particular aspect, an interchangeable drawer cover for furniture and cabinets is disclosed. The interchangeable drawer cover includes a substrate having a first surface and a second surface. The substrate comprises a first material. In addition, the drawer cover includes a first decorative layer overlaying the first surface of the substrate, where the first decorative layer includes a second material. The drawer cover also includes a plurality of apertures formed in the drawer cover aligned parallel to a top edge of the drawer cover, where the substrate and the first decorative layer are sized and shaped to fit over a front of drawer of the furniture.

The drawer cover may also include a second decorative layer overlaying the second surface of the substrate, where the second decorative layer comprises the second material, and the second material comprises vinyl. The drawer cover may also include horizontal and vertical perforations spaced inward from respective edges of the interchangeable drawer cover, where the horizontal and vertical perforations pass through the first decorative layer, substrate, and second decorative layer.

The drawer cover may also be provided with a plurality of screws, where each screw has a diameter sized to pass through a respective aperture. In addition, the drawer cover may also be provided with a plurality of pulls, where each pull having a width larger than a respective aperture.

The substrate may comprise a polymeric foam, and where the first decorative layer has a first design printed thereon, and the second decorative layer has a second design printed thereon that is different than the first design.

In another aspect, a method of fabricating an interchangeable drawer cover is disclosed. The method includes providing a substrate having a first surface and a second surface, where the substrate comprises a first material. The method also includes adhering a first decorative layer over the first surface of the substrate, where the first decorative layer comprises a second material, and forming a plurality of apertures in the drawer cover that are aligned parallel to a top edge of the drawer cover. The substrate and the first decorative layer are sized and shaped to fit over a front of drawer of the furniture. In addition, the method includes adhering a second decorative layer over the second surface of the substrate, where the second decorative layer comprises the second material.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
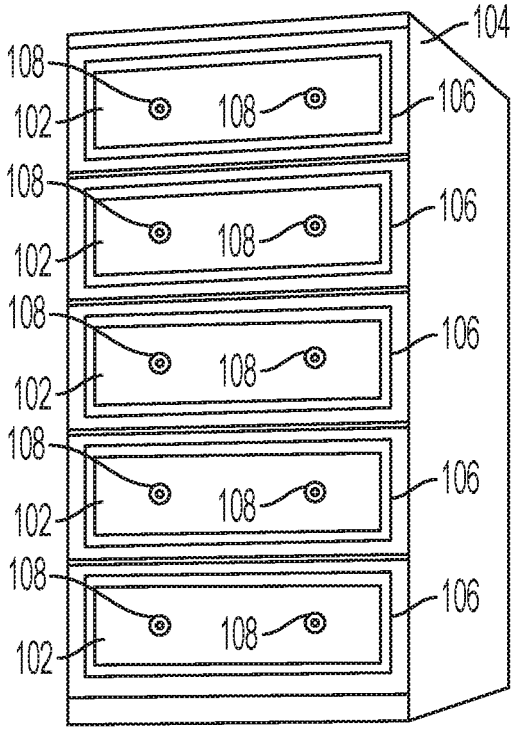
FIG. 1 is a perspective view of a dresser showing a drawer cover installed on each drawer front of the dresser in accordance with an embodiment of the present invention.

Referring now to FIG. 1, a set of interchangeable drawer covers 102 for furniture are installed on a front of each drawer 106 of a dresser 104. The drawer covers 102 are held in place using drawer pulls 108 that are mechanically attached to the respective drawer 106. For example, the drawer pulls 108 may be attached and secured to the respective drawer 108 by a screw 112*a*, 112*b* or bolt, for example. Accordingly, the respective screw 112*a*, 112*b* of the drawer 106 pull 108 passes through respective apertures 110*a*, 110*b* formed in the drawer cover 102 and spaced apart. The apertures 110*a*, 110*b* are aligned parallel to a top edge of the drawer cover 102 so that the drawer cover 102 is aligned when installed on the drawer 108. The drawer pull 108 has a larger diameter or width than the apertures 110*a*, 110*b* of the drawer cover 102 in order to firmly hold the drawer cover 102 to the drawer 106.

Figure 3:
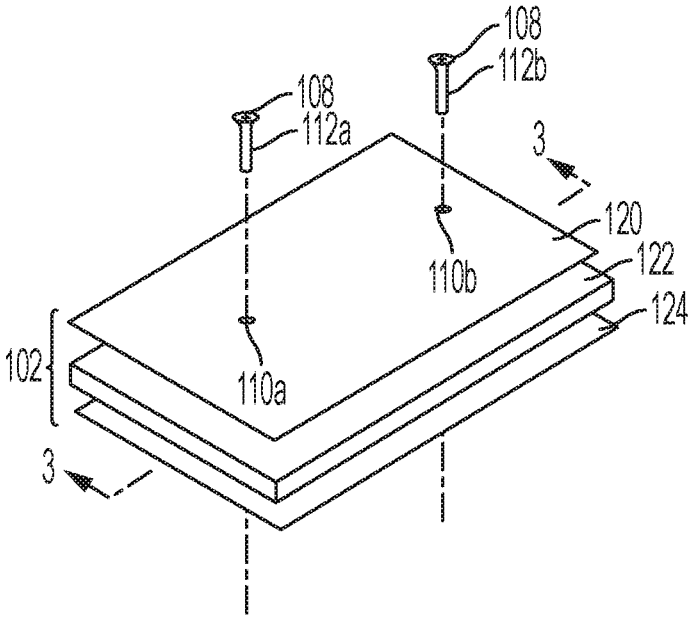
FIG. 3 is an exploded perspective view of the drawer cover of FIG. 1.
Figure 4:
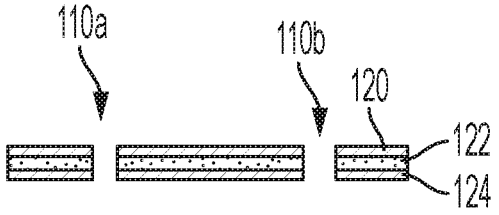
FIG. 4 is a cross section of the drawer cover taken in the direction of line 3-3 in FIG. 3.

In a particular aspect the drawer covers 102 comprise a first decorative layer 120, a substrate 122, and a second decorative layer 124 as shown in FIGS. 3 and 4. The first and second decorative layers 120, 124 may comprise polyvinyl chloride (PVC) (i.e. vinyl), polypropylene, polyethylene, polyester, ethylene vinyl acetate, or other appropriate polymeric formulations. Alternatively, the first and second decorative layers 120, 124 may comprise paper stock having a water resistant coating. The substrate 122 may comprise a polymeric or PVC foam or other suitable material for adhering the first and second decorative layers 120, 124 thereto.

Figure 2A:
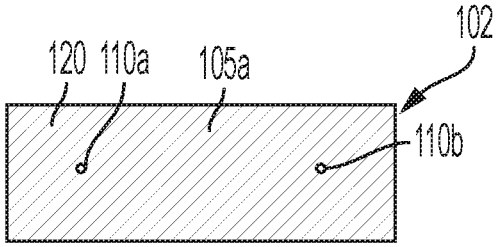
FIG. 2*a* is a front view of the drawer cover of FIG. 1 displaying a first design.
Figure 2B:
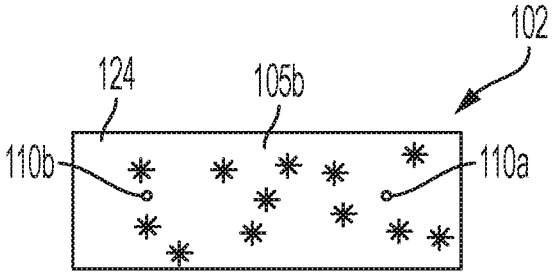
FIG. 2*b* is a rear view of the drawer cover of FIG. 2*a* displaying a second design.

The first and second decorative layers 120, 124 have a print or design thereon for aesthetic purposes. In a particular aspect, a first design 105*a* on the first decorative layer 120 is different than a second design 105*b* on the second decorative layer 124 as shown in FIGS. 2*a* and 2*b*. Accordingly, the set of drawer covers 102 are reversible to display either the first design 105*a* on the first decorative layer 120 or the second design 105*b* on the second decorative layer 124. The drawer cover is flexible in a particular embodiment, and is rigid in another embodiment.

The appearance of the designs 105*a*, 105*b* of the set of drawer covers 102 may match a set of sheets, towels, bath rugs, etc. In addition, the designs 105*a*, 105*b* could be holiday related. For example, the first design 105*a* on the first decorative layer 120 could have a Thanksgiving themed design to display during the Thanksgiving holidays, and the second design 105*b* on the second decorative layer 124 could have a Christmas themed design to display during the Christmas holiday, for example.

The first and second decorative layers 120, 124 have a smooth surface and are fabricated so that they do not scratch or damage the front of the drawer 106. In addition, by having the same material for both the first decorative layer 120 and the second decorative layer 124 (i.e., vinyl), this prevents the corners of the drawer covers 102 from curling. In the embodiment illustrated herein, vinyl was used. However, instead of the first and second vinyl layers 120, 124, another material could be used other than vinyl as long as the first and second decorative layers 120, 124 were comprised of the same material. For example, the first and second decorative layers 120, 124 could be comprised of a wood laminate or PVC material.

Figure 5:
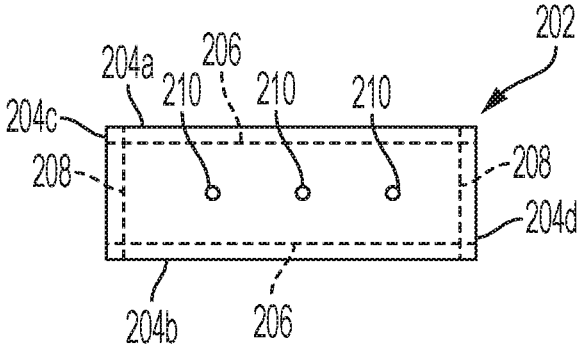
FIG. 5 is a front view of the drawer cover having perforations in accordance with a particular aspect of the present invention.

Referring now to FIG. 5, in a particular embodiment a drawer cover 202 may have horizontal perforations 206 and vertical perforations 208 spaced apart from respective edges 204*a*, 204*b*, 204*c*, 204*d* of the drawer cover 202. This allows the drawer cover 202 to be adjusted in size to accommodate a variety of sizes of drawers 106.

For example, top and bottom strips formed between the horizontal perforations 206 and the respective edges 204*a*, 204*b* of the drawer cover 202 can be torn free from the drawer cover 202. This reduces the vertical dimension of the drawer cover 202. Similarly, left and right strips formed between the vertical perforations 208 and the respective edges 204*c*, 204*d* of the drawer cover 202 can be torn free from the drawer cover 202. This reduces the horizontal dimension of the drawer cover 202. The perforations 206, 208 extend through the drawer cover 202.

In addition, the drawer cover 202 may include a plurality of circular perforations 210. The circular perforations 210 are positioned on the drawer cover 202 in locations where a drawer pull 108 most likely would be aligned when the drawer cover 202 is installed on a drawer 106. Accordingly, the screw 112*a*, 112*b* or bolt of the drawer pull 108 can be used to form appropriate apertures within the drawer cover 202 by punching in a center of the circular perforations 210 in order to remove a circular piece of material from the drawer cover 202. The drawer cover 202 can then be attached to the drawer 106 as described above by passing the screw 112*a*, 112*b* or bolt of the drawer pull 108 through the drawer cover 202.

In another aspect, a method of fabricating an interchangeable drawer cover is disclosed. The method includes providing a substrate 122 having a first surface and a second surface, where the substrate 122 comprises a first material. The method also includes adhering a first decorative layer 120 over the first surface of the substrate 122, where the first decorative layer 120 comprises a second material, and forming a plurality of apertures 110*a*, 110*b* in the drawer cover 102 that are aligned parallel to a top edge of the drawer cover 102. The substrate 122 and the first decorative layer 120 are sized and shaped to fit over a front of drawer of the furniture. In addition, the method includes adhering a second decorative layer 124 over the second surface of the substrate 120, where the second decorative layer 124 comprises the second material.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An interchangeable drawer cover for furniture to be installed on a drawer using drawer pulls, the cover comprising:

a substrate comprising polymeric foam and having a first surface and a second surface opposite the first surface, the substrate comprising a first material;

a first decorative layer overlaying the first surface of the substrate, the first decorative layer comprising a second material;

a second decorative layer overlaying the second surface of the substrate, the second decorative layer comprising the second material;

a plurality of apertures adjacent to each other and aligned parallel to a top edge of the drawer cover with each aperture configured to accommodate a drawer pull; and horizontal and vertical perforations passing through the first decorative layer, substrate, and second decorative layer and the horizontal and vertical perforations spaced inward from respective edges of the interchangeable drawer cover to form strips and can be torn free from the cover;

wherein the substrate and the first and second decorative layers are sized and shaped to fit over a front of drawer of the furniture.

2. The interchangeable drawer cover of claim 1, wherein the second material comprises vinyl.

3. The interchangeable drawer cover of claim 1, wherein the first decorative layer having a first design printed thereon, and the second decorative layer have a second design printed thereon that is different than the first design.

4. A method of fabricating an interchangeable drawer cover, the method comprising:

providing a substrate comprising polymeric foam and having a first surface and a second surface;

adhering a first decorative layer over the first surface of the substrate, the first decorative layer comprising a second material;

adhering a second decorative layer over the second surface of the substrate, the second decorative layer comprising the second material; and forming a plurality of apertures in the drawer cover aligned parallel to a top edge of the drawer cover with each aperture configured to accommodate a drawer pull;

forming horizontal and vertical perforations passing through the first decorative layer, substrate, and second decorative layer, the horizontal and vertical perforations are spaced inward from respective edges of the interchangeable drawer cover that form strips that can be torn free from the cover;

wherein the substrate and the first and second decorative layers are sized and shaped to fit over a front of drawer of the furniture.

5. The method of claim 4, wherein the first decorative layer comprises vinyl.

6. The method of claim 4, further comprising printing a first design on the first decorative layer, and printing a second design on the second decorative layer that is different than the first design.

* * * * *